US005119712A

United States Patent [19]

Kato

[11] Patent Number: 5,119,712

[45] Date of Patent: Jun. 9, 1992

[54] CONTROL APPARATUS FOR ELECTRONIC MUSICAL INSTRUMENT

[75] Inventor: Hitoshi Kato, Tokyo, Japan

[73] Assignee: Casio Computer Co., Ltd., Tokyo, Japan

[21] Appl. No.: 465,038

[22] Filed: Jan. 16, 1990

[30] Foreign Application Priority Data

Jan. 19, 1989 [JP] Japan ..... 1-10661
Jan. 19, 1989 [JP] Japan ..... 1-10662
Jan. 19, 1989 [JP] Japan ..... 1-10663

[51] Int. Cl.[5] ..... G10H 1/053

[52] U.S. Cl. ..... 84/626; 84/658; 84/687

[58] Field of Search ..... 84/DIG. 7, 742, 615, 84/626, 658, 687, 690

[56] References Cited

U.S. PATENT DOCUMENTS 4,655,115 4/1987 Nishimoto ..... 84/624
4,662,261 5/1987 Akutsu ..... 84/615
4,699,037 10/1987 Minamitoka et al. ..... 84/DIG. 7
4,715,257 12/1987 Hoshioi et al. ..... 84/603
4,748,887 6/1988 Marshall ..... 84/DIG. 30
4,875,400 10/1989 Okuda et al. ..... 84/626
4,915,008 4/1990 Sakashita ..... 84/658
4,919,032 4/1990 Sakashita ..... 84/653
4,932,304 6/1990 Franzmann ..... 84/671
4,939,975 7/1990 Sakashita ..... 84/626
4,972,753 11/1990 Adachi et al. ..... 84/626
4,993,307 1/1991 Sakashita ..... 84/615

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

Even though a control apparatus adapted for controlling a sound source of a keyboard type musical instrument is used with any type of electronic instruments connected therewith as a performance input apparatus, the control apparatus can provide after-touch effect as a user expects. Especially when a wind instrument playing mode is selected the control apparatus generates control data in a state inherent to a wind instrument playing mode on the basis of the received after-touch data to control musical tones, and suppresses amplitudes of variations of the control data when the after-touch data vary within a low amplitude range. Further, when the control apparatus has received a plurality of after-touch data, the control apparatus obtains only one of after-touch data, which is to be processed, thereby applying after-touch effect to musical tones with no time delay after a player's playing operation.

5 Claims, 12 Drawing Sheets

| | SENSE | AMP BIAS | VIBRATO |
|---|---|---|---|
| AFTER TOUCH | 99 | ON | OFF |
| MODULATION WHEEL | 0 | OFF | ON |
| DEFINABLE CONTROLLER | 50 | OFF | ON |
| FOOT VOLUME | 0 | OFF | OFF |

OPERATION MEMORY

NORMAL

COMBI-NATION

MULTI CHANNEL

COMPARE/ RECALL

WRITE COPY/INIT

TOTAL CONTROL

EDIT

BANK M ON/OFF

SHIFT 3-2

YES/SUS
3-3

PAGE 3-2
CURSOR 3-3
NO/END VALUE

CONTROL APPARATUS FOR ELECTRONIC MUSICAL INSTRUMENT

BACKGROUND OF THE INVENTION

1. Field of the Invention

The present invention relates to a control apparatus for an electronic musical instrument, and more particularly to a control technique for causing after-touch input data to reflect on musical tones generated by a sound source.

2. Description of the Related Art

Electronic musical instruments of a keyboard type have been mainly developed in the history of the development of electronic musical instruments. Inevitably, control apparatus (typically a micro-computer) for electronic musical instruments of a keyboard type have been seriously developed with a theme to be solved that a sound control can be performed suitably for a manipulator of a keyboard type instrument such as a keyboard, bender, modulation wheel, pedal and the like. In addition, communication technique, for example, MIDI (Musical Instrument Digital Interface) has been developed so as to be used suitably for electronic musical instruments of a keyboard type.

In recent times however, electronic musical instruments other than that of a keyboard type have been widely used, and particularly, electronic stringed instruments of a guitar type and electronic wind instruments of a reed type have been put into practice. Users of these instruments often connect various types of electronic musical instruments to each other, thereby playing those instruments, and wherein a wide variety of ways of expression of music have been proposed.

Unfortunately, an electronic musical instrument with a sound source capable of being connected to an external electronic musical instrument as a controller (a performance input apparatus) is constructed such that its control apparatus is suitably connected to a performance input apparatus of a keyboard type. Therefore, this electronic musical instrument can not be properly used with an arbitrary type of performance input apparatus. A method of playing a typical keyboard instrument and a method of playing a typical wind instrument are greatly different from each other and furthermore musical spaces which a player wants to express with these playing methods are quite different and the musical instruments respond in quite different ways depending on these playing methods. Needless to say, it is preferable in application of the electronic musical instruments that the essential difference in methods of playing the musical instruments causes the sound sources to respond in different ways and a performance effect is expressed as the player intended.

For instance, after-touch data of a keyboard type instrument is detected from key-depression pressure after key depression, while after-touch data of a wind instrument is given by output of a breath-sensor and/or lip-sensor. A control apparatus for a performance-input apparatus of a keyboard instrument serves to control to linearly change a musical-tone characteristic (for example, sound volume) in response to after-touch input. Meanwhile, the musical-tone characteristic is not always changed linearly in the wind musical instrument. More specifically, it is preferable that the sound volume may be linearly changed in response to change in after touch, when sensibility of a sensor is low, and when sensibility of the sensor is somewhat high, the sound volume is scarcely affected by a low value of after-touch data, and also when the sensibility of the sensor becomes of a certain value, the sound volume is greatly changed responding to a slight change in after-touch data. However, a conventional control apparatus for the keyboard instrument linearly changes a musical-tone characteristic in response to after-touch data input. Accordingly, when the above conventional control apparatus is used with an electronic wind instrument connected therewith as a performance input apparatus, a problem is left that performance expression shall be far from satisfaction of the instrument player. Since keyboard operation itself has only limited degree of freedom, a comparatively slow change in key depression is detected as after-touch data generated by keyboard operation. Therefore, the control apparatus for the keyboard instrument can provide after-touch effect without hindrance. Meanwhile, a breath controller of the wind instrument generates after-touch data which changes with a high degree of freedom in accordance with sensitive breath control by the instrument player. However, it shall be difficult to receive after-touch data from the breath controller as intended to obtain by the player and to process the data so as to control musical tones as expected, because of drawbacks in a digital system such as accuracy of a breath-detection element, the resolution of A/D converter, the accuracy of after-touch data which the control apparatus receives and processes. Particularly, while the player controls the air flow he supplies to the instrument to provide a constant breath flow, fractional variations in after-touch data are frequently caused. The fractional variations in data directly reflect on control data for after-touch effect and whereby variations of characteristic of musical tones are frequently repeated. As a result, there is left a problem that unnatural sounds are generated (a limit cyclic problem).

A speed at which after-touch data are generated by keyboard operation is comparatively low, however in the wind instrument, the breath flow is finely controlled by the player. Accordingly, after-touch data are frequently produced and a result, a number of after-touch data shall be supplied to the control apparatus. The control apparatus of the wind instrument needs a considerable time for processing data, when it processes all of received after-touched data as the control apparatus of the keyboard instrument processes all of the data. Therefore, a sound source of the wind instrument, in practice, shall generate musical tones with after-touch effect a little late after the playing operation of the player. In addition, not only the musical tones are generated a little late, but also the time lag of the musical tones varies depending on the variation in the speed at which after-touch data are produced. As a result, the performance effect is far from what the player expected.

The above described problems and/or drawbacks appear also in the control apparatus used only for an electronic wind instrument and have been waited to be solved.

SUMMARY OF THE INVENTION

An object of the present invention is to provide a control apparatus for an electronic musical instrument, which is capable of generating after-touch effect differently as a player intends to obtain for the types of instruments to be played, and particularly a wind instrument.

According to one aspect of the present invention, there is provided a control apparatus for an electronic musical instrument, which comprises:

after-touch data receiving means for receiving after-touch data;

mode selecting means for selecting a desired instrument playing mode from a plurality of instrument playing modes including a wind-instrument playing mode;

mode storing means for storing a data representing the instrument playing mode selected by said mode selecting means;

control data outputting means for outputting control data for controlling a characteristic of a musical tone on the basis of the after-touch data received by said after-touch data receiving means; and said outputting means outputting the control data in a different state from that in other instrument playing mode, when a data representing the wind-instrument mode has been stored in said mode storing means.

According to the present invention, when the wind-instrument playing mode is selected a performance is executed with a manipulator of the wind instrument, and control data is generated which controls a characteristic of a musical tone in a way inherent in the wind-instrument playing mode. Therefore, after-touch effect as the player expects is easily provided.

Another object of the present invention is to provide a control apparatus for an electronic musical instrument to which various types of performance controllers are connected and after-touch data is input that represents a different state of playing operation every situation in which it is used, and which is capable of applying after-touch effect as a player intends to obtain to a musical tone.

According to another aspect of the present invention, there is provided a control apparatus for an electronic musical instrument, which comprises:

after-touch data receiving means for receiving after-touch data;

mode selecting means for selecting a desired instrument-playing mode from a plurality of instrument-playing modes including a wind-instrument-playing mode;

mode storing mode for storing a data representing the instrument-playing mode selected by said mode selecting means; and control data generating means for generating control data for controlling a characteristic of a musical tone on the basis of the after-touch data received by said after-touch data receiving means;

said control data generating means generating the control data for suppressing a rate of variation of the musical tone to that of the after-touch data, when a variation amplitude of the after-touch data is relatively small.

According to the present invention, when the variation of after-touch data is large in the wind-instrument playing mode, control data is generated provided that the intention of the player is expressed in the variation of after-touch data, however when the amplitude of the variation of after-touch data is small, the amplitude of variation in control data is suppressed, because the intention of the player is not directly expressed in the variation of after-touch data but rather smooth and/or soft after-touch effect is expected by the player.

As a result, a characteristic variation of dicordant musical tone disappears and such after-touch effect as the player expected is obtained. In a mode other than the wind-instrument playing mode, since an operation process in the control-data generating means becomes simple (or the operation process is executed in a short time), much time can be used for executing musical-tone control based on other performance control data (note on/off and the like) by other means included in the control apparatus. Therefore, it is possible to effectively driving a sound source by the control apparatus within limit of a real time process. Note that though processing amount for obtaining control data from after-touch data increases a little when the wind instrument playing mode is selected, a process originated from a polyphonic instrument such as a keyboard instrument is not required, since in general, a wind instrument is a monophonic instrument.

Further, yet another object of the present invention is to provide a control apparatus for an electronic musical instrument, which is capable of suppressing a limit cyclic characteristic variation of a musical tone originated from small cyclic variation in after-touch data supplied from a performance controller, even when a breath controller and/or a lip controller of a wind instrument are used, thereby realizing after-touch effect as a player intends to obtain by controlling his breath flow.

According to yet another aspect of the present invention, there is provided a control apparatus for an electronic musical instrument, which comprises:

after-touch data receiving means for receiving after-touch data;

mode selecting means for selecting a desired instrument playing mode from a plurality of instrument playing modes including a wind-instrument playing mode;

mode storing means for storing a data representing the instrument playing mode selected by said mode selecting means;

control data generating means for generating control data from the after-touch data received at every cycle; and smoothing means adapted to operate when a data representing the wind-instrument playing mode is stored in said mode storing means, so as to smooth the control data generated by said control data generating means while variation in the control data is small.

According to the present invention, since the smoothing operation is executed for control data which have a direct influence upon the musical-tone characteristic (not for after-touch data before transformation), it is possible to easily prevent generation of limit cyclic phenomenon of musical tones.

Further another object of the present invention is to provide a control apparatus for an electronic musical instrument, which is adapted, as an after-touch controller, for use with an arbitrary type of performance controller, and which is capable of applying after-touch effect as the player intends to obtain to musical tones without any substantial time lag, even when the performance controller of the wind instrument is used.

According to one of aspects of the present invention, there is provided a control apparatus for an electronic musical instrument which comprises:

after touch-data receiving means capable of receiving periodically a plurality of after-touch data;

after-touch data evaluation means for evaluating one of after-touch data to be processed, which is obtained from a plurality of after-touch data, when said after-touch data receiving means has received a plurality of after-touch data; and control data generating means for generating control data for controlling a characteristic of a musical tone to be generated, on the basis of the after-touch data to be processed.

According to the present invention, the above control data generating means processes only one after-touch data at every operation cycle, so that there is no substantial delay of the process in the control data generating means. Accordingly, even though the performance controller is used, which processes a number of after-touch data as in the electronic wind instrument, after-touch effect of musical tones is obtained without any delay from the playing operation of the player.

The term "periodically" used in this specification not only means that time intervals of evaluation are completely constant, or evaluation is executed at a constant time interval, but also includes variations in time intervals determined depending on the amounts of data other than after-touch data to be processed in data-processing systems in such a case the data-processing system of the control apparatus for an electronic musical instrument, is composed of a microcomputer that operates under control of a program.

A still another object of the present invention is to provide a control apparatus for an electronic wind musical instrument, which is capable of providing after-touch effect as an instrument player intends to obtain when he plays an electronic wind instrument.

According to a yet another aspect of the present invention, there is provided a control apparatus for an electronic wind instrument, which comprises:

sensor-output receiving means for receiving breath-sensor output data from a breath sensor; and control-data output means for controlling a characteristic of a musical tone on the basis of the breath-sensor output data received by said sensor-output receiving means by outputting control data for non-linearly changing a rate of variation of the characteristic of a musical tone to variation of the breath-sensor output data.

According to the present invention, after-touch effect is easily realized, as the player of the electronic wind instrument expects.

Further, another object of the present invention is to provide a control apparatus for an electronic wind instrument, which is capable of applying after-touch effect on a musical tone as the instrument player intends to express.

According to another aspect of the present invention, there is provided a control apparatus for an electronic wind instrument, which comprises:

sensor-output receiving means for receiving breath-sensor output data; and control data outputting means for controlling a characteristic of a musical tone on the basis of the breath-sensor output data received by said sensor-output receiving means by outputting control data for suppressing a rate of variation of the musical tone to variation of the breath-sensor output data when amplitude of variation of the breath-sensor output data is small.

According to the present invention, the amplitude of variation in the control data is suppressed, when the amplitude of variation in the breath-sensor output data is small and whereby characteristic variation of a discordant musical tone is disappeared and after-touch effect is always obtained as the instrument player expects.

It is further another object of the present invention to provide a control apparatus for an electronic wind instrument, which suppresses limit cyclic characteristic variation of a musical tone originated from small cyclic variation in breath-sensor output data of the electronic wind instrument and is capable of realizing after-touch effect as the player expects to express by controlling his breath flow.

According to the other aspect of the present invention, there is provided a control apparatus for an electronic wind instrument, which comprises:

sensor output receiving means for receiving breath-sensor output data from a breath sensor;

control-data generating means for generating at every cycle control data from the breath-sensor output data received by said sensor output receiving means; and smoothing means for smoothing the control data generated by said control-data generating means while variation of the control data is small.

According to the present invention, limit cyclic phenomenon is easily prevented from being caused to musical tones.

BRIEF DESCRIPTION OF THE DRAWINGS

These and other objects and advantages of the present invention will be apparent from the following description of preferred embodiments and the accompanying drawings in which.

DETAILED DESCRIPTION OF PREFERRED EMBODIMENTS

Embodiments of the present invention will be described hereinafter with reference to the accompanying drawings.

In the present embodiment, after-touch data is changed on the basis of its corresponding sensitivity data. A data-transformation table means is prepared for production of control data in the wind-instrument playing mode. Control-data generating means is constructed such that when the wind-instrument playing mode is selected, it generates control data to at least a part of a whole range of sensitivity data with reference to the data-transformation table means.

In the embodiment, after-touch data evaluation means selects the maximum value of after-touch data as after-touch data to be processed, when a plurality of after-touch data are received. The evaluation logic allows instantaneous generation of after-touch effect in response to playing operation by the player to add attach portions or sound-pressure increasing portions to a flow of musical performance or in response to player's operation to supply breath flow to the mouth piece of the wind instrument right after tonguing.

OVERALL CONSTRUCTION

Figure 1:
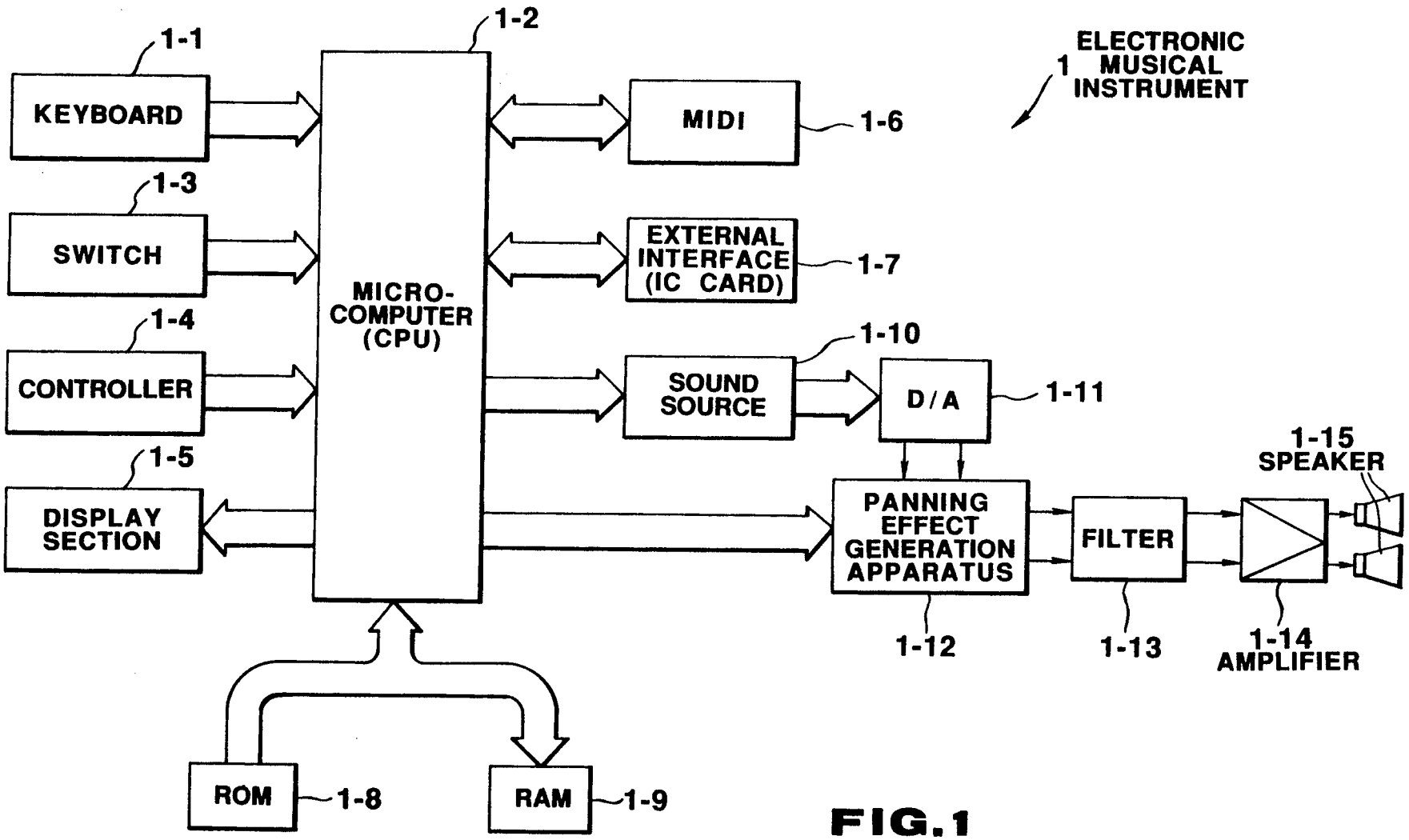
FIG. 1 is a view showing the whole construction of an electronic musical instrument to which the present invention is applied.

An overall construction of the electronic musical instrument embodying features of the invention is shown in FIG. 1. At a keyboard 1-1, various data as operated-key data such as key-codes, key-depression speed data, key-release speed data and key-depression pressure data (after-touch data of a keyboard) are detected and transferred to a micro-computer (CPU) 1-2 as a control apparatus of the present electronic musical instrument 1. A switch 1-3 is comprised of a series of function switches and a state of each function switch is transferred to the micro-computer 1-2 and is processed therein. A controller 1-4 comprises performance manipulators other than the keyboard 1 and includes a manipulator of a bender wheel for varying a musical-tone pitch, that of a modulation wheel for varying a tremolo-depth and that of a definable wheel affecting one and/or more pre-set musical-tone elements. Data of each of these manipulators is sent to the micro-computer 1-2. A display section 1-5 is composed of LED display and/or LCD (liquid crystal display) and it displays the present performance state, operation state of the electronic musical instrument and set-data under control of the micro-computer 1-2. MIDI is also an external interface which the micro-computer 1-2 uses to data-communicate with an external electronic musical instrument, sequencer and the like. The other external interface 1-7 is used between the micro-computer 1-2 and IC-card. The micro-computer 1-2 fetches data and a program from IC-card through the external interface 1-7 and/or writes data and a program into IC-card through the same. The micro-computer 1-2 has ROM 1-8 and RAM 1-9. ROM 1-8 stores a program to control the operation of the present electronic musical instrument 1, tone-color data and performance data. RAM 1-9 temporarily stores data which are used while a program is running, such as tone-color data, tone-color control data, performance data and performance-state data.

A sound source 1-10 generates a plurality of musical-tone signals of sounds under control of the micro-computer 1-2. A sound source of iPD (interactive Phase Distortion system) as disclosed in patent application Ser. No. 62-249467 may be used as the above sound source 1-10. Digital musical-tone signals of respective channels (2 channels in the present embodiment) are transferred to D/A converter 1-11 and are converted into analog musical-tone signals of respective channels, which are input to a panning-effect generation apparatus 1-12 which works under control of the micro-computer 1-2. The panning-effect generation apparatus 1-12 comprises two pairs of VCAs, which complementarily control amplitudes of analog musical tone signals of respective channels. Two outputs from two VCAs out of four VCAs in total are mixed to form right and left channel signals of a stereo-phonic system, and whereby a location of a sound image of each channel is controlled. Signals of right and left channels from the panning-effect generation apparatus 1-12 are sent to a filter 1-13, where their unnecessary frequency components are removed and are amplified by an amplifier 1-14 and thereafter are acoustically output through right and left speakers 1-15, respectively.

FUNDAMENTAL OPERATION

Fundamental operation of the electronic musical instrument 1 will be described with reference to FIGS. 2A to 2F.

Figure 2A:
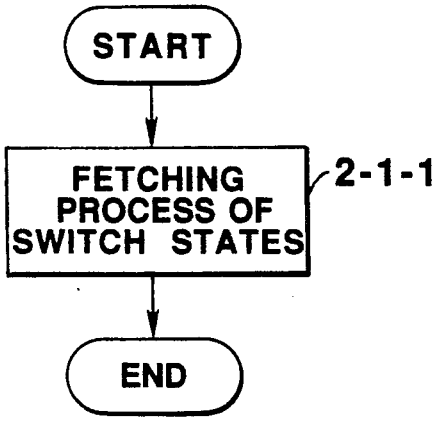
FIG. 2A is a flow-chart of a timer interrupt servicing routine for fetching states of a keyboard 1—1 and a switch 1-3 of FIG. 1 to a micro-computer 1-2.

FIG. 2A is a flow-chart of a first timer interrupt routine 2-1-1, which is started at every certain interval. At the routine 2-1-1, state of the keyboard 1-1 and states of the switches of the switch 1-3 are fetched into the micro-computer 1-2.

Figure 2C:
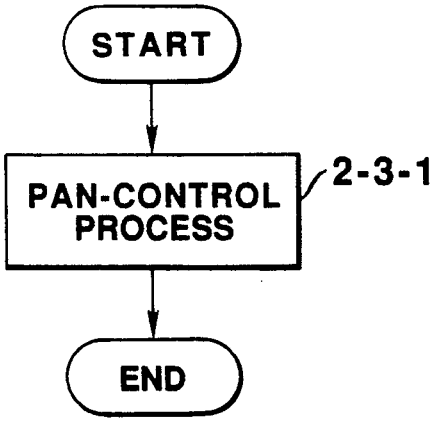
FIG. 2C is a flow-chart for controlling a panning effect generation apparatus of FIG. 1.
Figure 2B:
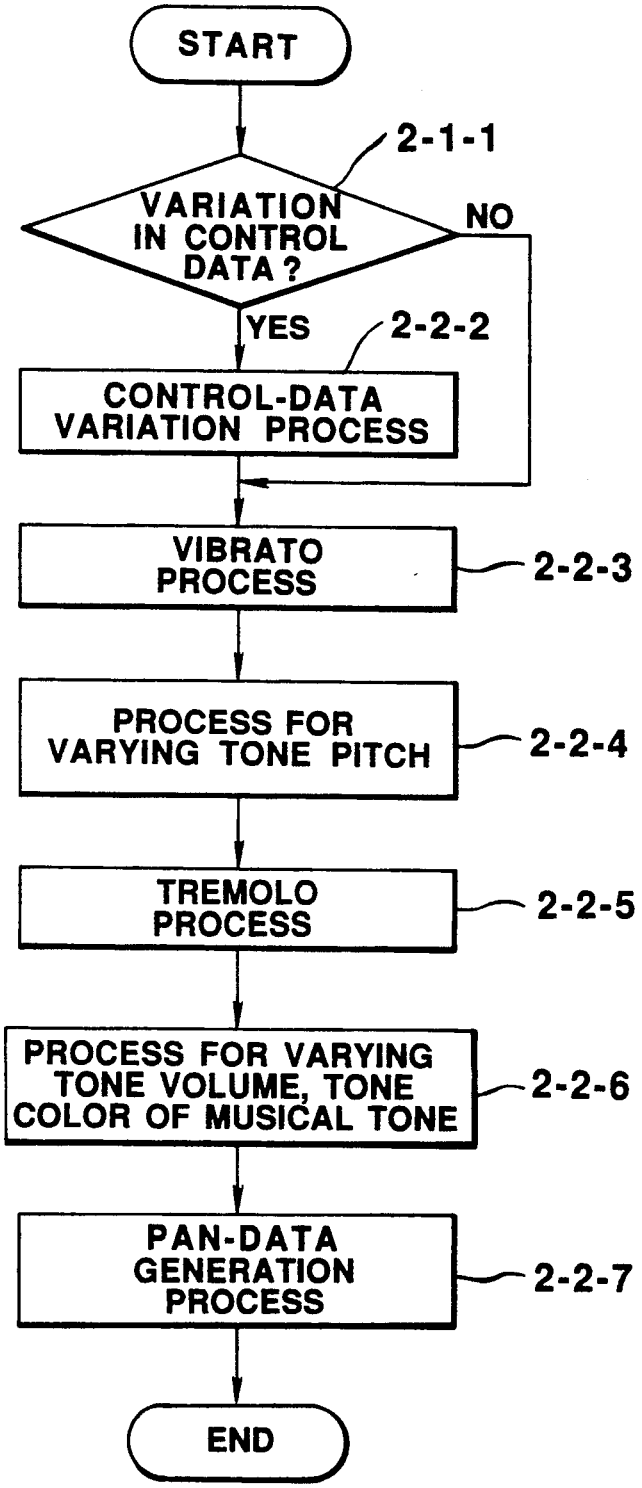
FIG. 2B is a flow-chart showing a timer interrupt servicing routine of processing of various musical-tone characteristic controls.

FIG. 2B is a flow-chart of a second timer interrupt routine 2-2-1, where data of a controller 1-4 is fetched into the micro-computer 1-2 and is compared with the preceding data of the controller 1-4 to check if there is caused any variation in data of the controller 1-4. If variation in control data is detected, control data variation process 2-2-2 is executed. At the following step 2-2-3, an operation is executed to realize vibrato. More specifically, present vibrato data is produced from data which affects vibrato, such as a reference-rate data, reference depth data, control data for modulating vibrato parameter and MIDI data. At step 2-2-4, an operation is executed on vibrato data, MIDI data, control data in accordance with pitch-variation state of the system so as to vary pitch of a musical tone. The result of the operation is sent to the sound source 1-10 to control pitch of a musical tone. At step 2-2-5, an operation is executed on data to obtain tremolo growl. This operation includes operations which are to be executed when tremolo or growl is modulated by control data or by MIDI data. At step 2-2-6, an operation is executed on tremolo data, MIDI data (for instance after-touch data) and control data to actually vary tone color and tone volume of a musical tone and the operation result is sent to the sound source 1-10 to control tone color and tone volume of a musical tone. At the last step 2-2-7, pan-data generation process is executed to generate panning effect.

FIG. 2C is a flow-chart of a third timer interrupt routine 2-3-1, where the micro-computer 1-2 sends a control signal to the panning-effect generation apparatus 1-12 of FIG. 1 to realize the panning effect.

Figure 2D:
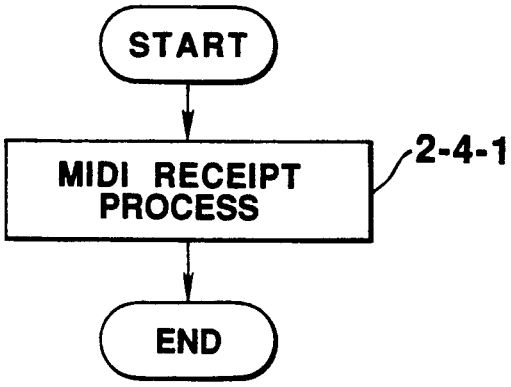
FIG. 2D is a flow-chart showing MIDI receiving process.
Figure 2E:
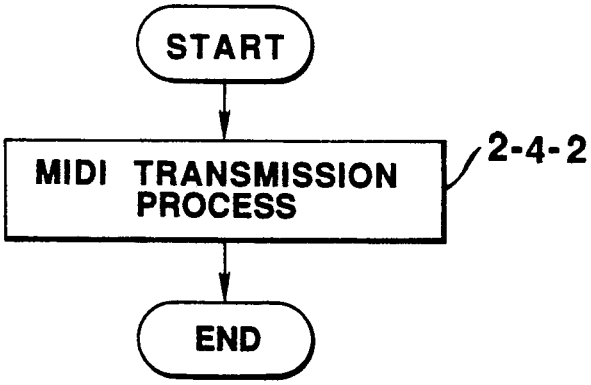
FIG. 2E is a flow-chart showing MIDI transmitting process.

FIG. 2D is a flow-chart of MIDI receipt process routine 2-4-1, which is started at an interruption from MIDI interface 1-6, when MIDI data is sent thereto. At the routine 2-4-1, only the process for receiving MIDI data (setting data to MIDI related buffer of RAM 1-9) is executed. FIG. 2E is a flow-chart of MIDI transmission process routine 2-5-1, which is started at an interruption from MIDI interface 1-6 when MIDI data is sent to an external electronic musical instrument, and thereby a transmission speed of MIDI data is maintained constant.

Figure 2F:
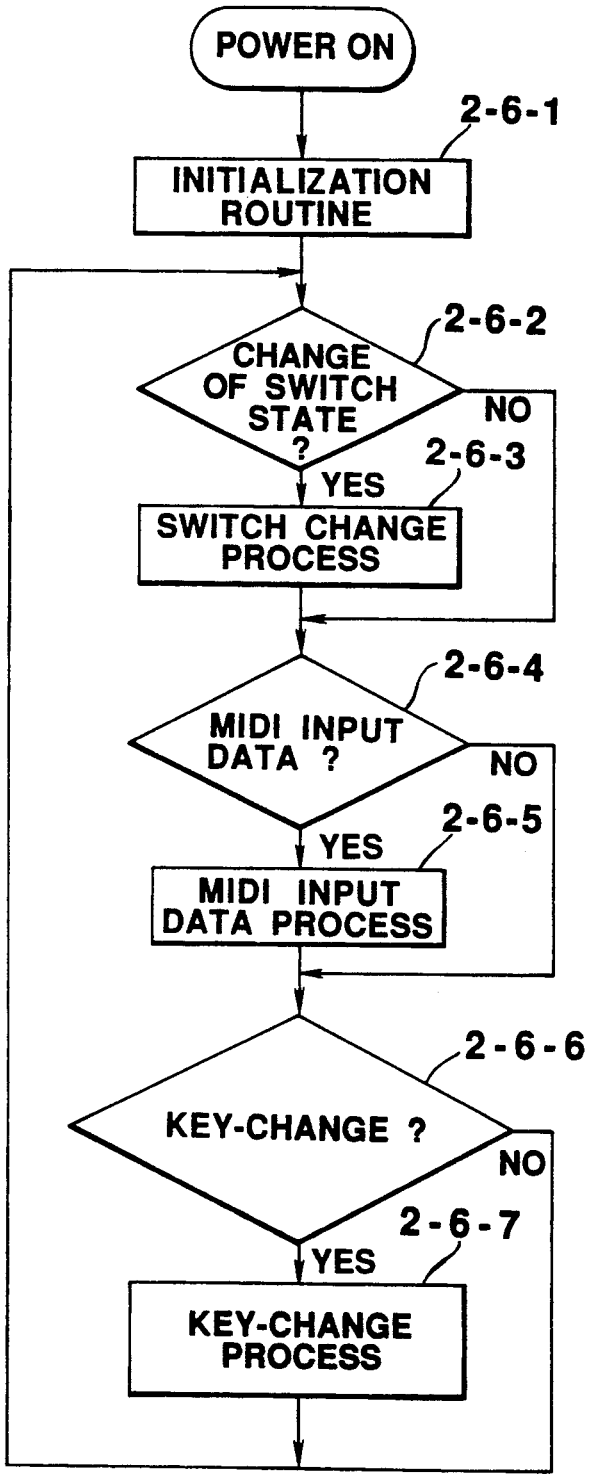
FIG. 2F is a flow-chart showing a whole operation.

FIG. 2F is a general flow-chart of the microcomputer 1-2. When a power supply is turned on, an initialization of the sound source 1-10, setting initial display data to the display section 1-5 and initialization of various control data and operation data are executed at initialization routine 2-6-1. At step 2-6-2, switch state is discriminated with reference to the interruption routine of the fetching process of keyboard/switch data (FIG. 2A). If change has been found in the switch state, switch-change process routine 2-6-3 is executed. At the routine 2-6-3 in accordance with system-state (menu) are executed setting of the playing mode, setting of tone-color data, setting of MIDI control data, setting of pan-control data, setting of musical control data to the sound source 1-10, setting of display data to the display section 1-5, initialization of control data, control of the panning effect generation apparatus 1-12, exchange of data and/or programs with the external interface 1-7 in IC-card and control of MIDI interface 1-6.

At step 2-6-4, a check is made with reference to a test flag raised in MIDI receipt process routine 2-4-1 (FIG. 2D) as to whether MIDI data has been input from MIDI interface 1-6. If MIDI data has been input to the micro-computer 1-2, MIDI input data process routine 2-6-5 is executed. At MIDI input data process routine 2-6-5, MIDI input data is discriminated. As a result of the discrimination, in accordance with the menu and set data in the routine 2-6-5 change of internal playing mode, change of tone-color data, change of pan control data, change of musical-tone control data, control of musical tones (note ON/OFF), control of displaying data and control of MIDI interface 1-6 are executed.

At step 2-6-6, a check is made with reference to the process result of the interruption routine 2-1-1 (FIG. 2A), as to whether state of the keyboard 1-1 has been changed i.e., whether any key has been depressed and/or any depressed key has been released. If the state of the keyboard 1-1 has been changed, at key change process routine 2-6-7 are executed change of data, assignment of sounds, sound-generation process, sound-cease process and control of MIDI interface 1-6 in accordance with operations of key-depression and/or key-release.

SETTING OF MUSICAL-TONE CONTROL DATA

Figures 3, 6:
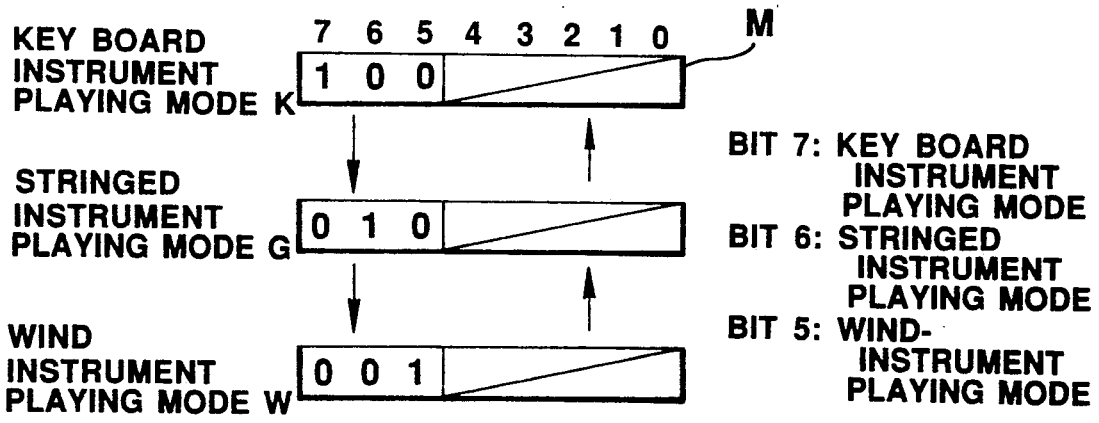
FIG. 3 is a view showing an example of data setting for musical-tone control.
FIG. 6 is a view showing mode data which is changed when the instrument playing mode is switched.

FIG. 3 is a view showing an example of setting of musical-tone control data. The musical-tone control data are set by operations of the switch 1-3 or the basis of MIDI data supplied externally. In FIG. 3, "Sense" is sensitivity-data taking a value of "0" to "99", "amp bias" is composed of parameters for controlling sound volume and tone color of a musical tone and "Vibrato depth" represents a depth of vibrato of LFO, i.e., variation range of a frequency. In case of iPD sound source, one sound or one sound generation channel is composed of a programable connection state of a plurality of modules (sound-generation algorithm, and "amp bias" in a module used for outputting a musical tone is a bias component for a amplitude or sound volume of a musical tone of its module, and further "amp bias" in a module which outputs a musical tone component to be input to other module serves as a bias component for changing tone color of the final output musical tone of a sound generation channel. After-touch, modulation wheel, definable controller and foot volume are terms of the controller (the manipulator). It is decided in accordance with ON, OFF shown in the Table, whether each controller affects musical-tone parameters (amp bias and vibrato depth in this embodiment). In other words, it is decided in accordance with ON, OFF shown in Table, whether musical-tone parameters are modulated or not. In the example of FIG. 3, for instance, the after touch is a controller (control data) which modulates the amp bias with it maximum sensitivity "99". This after touch may be data generated on the basis of key-depression pressure applied when the keyboard 1—1 of the electronic musical instrument body is operated, similar data supplied in MIDI format from an external electronic keyboard instrument, data generated when breathing operation is executed to an external electronic wind instrument and supplied in MIDI format and/or data generated when bowing operation is executed on an external electronic stringed instrument and supplied in MIDI format.

Any type of external electronic musical instruments (controller may be connected to the present embodiment through MIDI interface as a communication interface. After touch may be data representing breath-flow intensity, data representing key-depression pressure and/or data representing other playing-operation state in some case. In the light of these affairs, the electronic musical instrument according to the present invention is provided with a function of switching instrument-playing modes and is prepared for controlling after touch in accordance with the instrument playing mode, particularly in accordance with the wind-instrument playing mode.

Hereinafter it will be described in detail with reference to the embodiments of the present invention how the control of musical instruments is executed.

SETTING OF INSTRUMENT PLAYING MODE

Setting and changing of instrument playing modes will be described with reference to FIGS. 4 to 6.

Figures 4A, 4B, 4C, 4D, 4E, 4F, 4G, 4H, 4I, 4J, 4K, 4L, 4M, 4N, 4O, 4P:
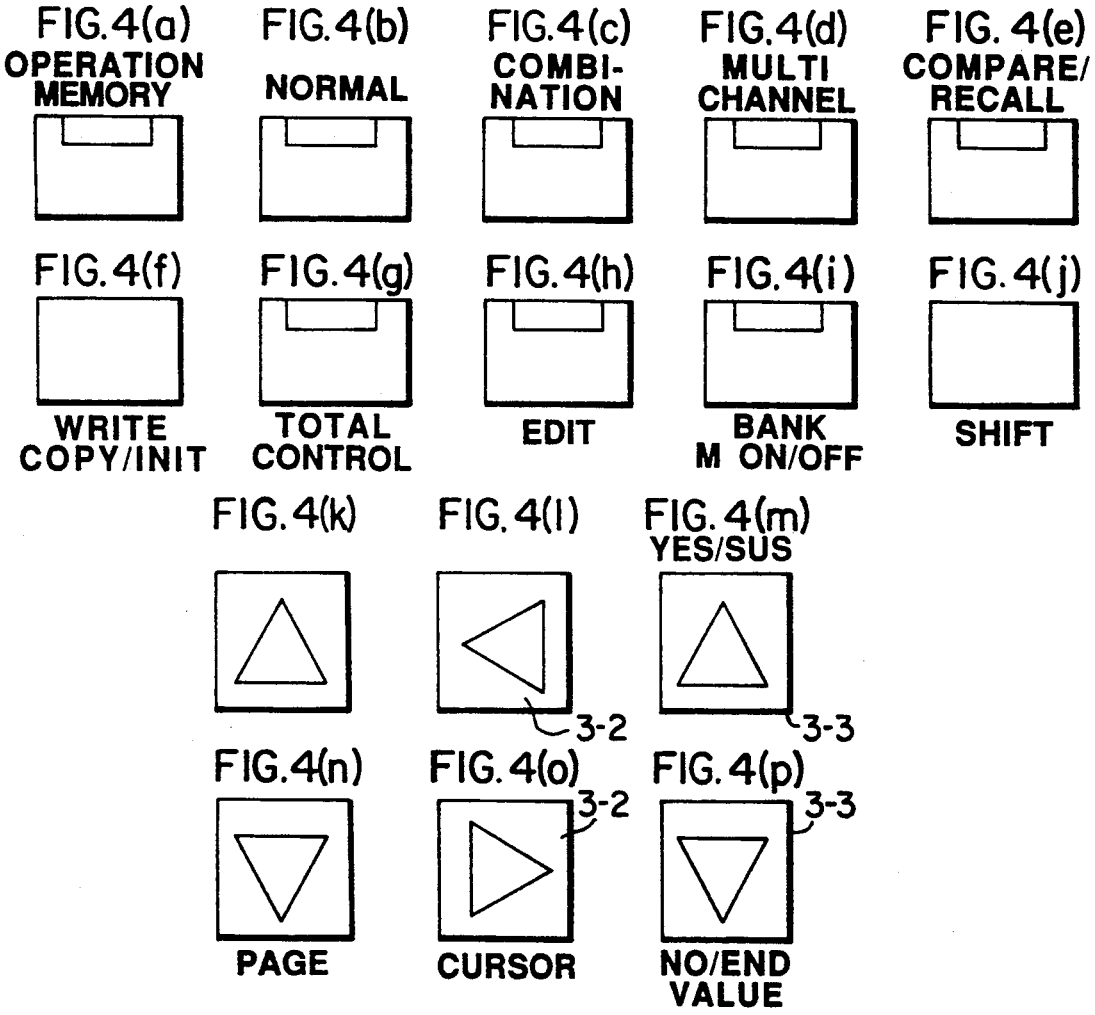
FIGS 4(*a*) to 4(*p*) are views showing a switch-arrangement of a switch 1-3 of FIG. 1.
Figure 5:
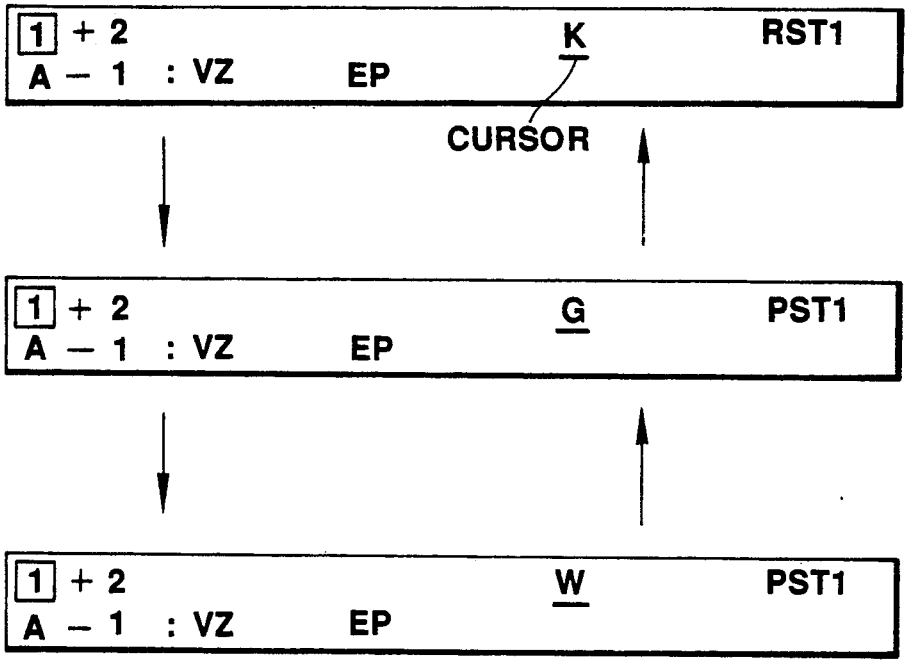
FIG. 5 is a view showing contents which are displayed on a display section 1-5 of FIG. 1, when instrument playing modes are switched.

FIGS. 4(*a*) to 4(*p*) are views showing all of the switches included in the switch 1-3 of FIG. 1. The instrument playing mode is set under a normal menu. The electronic musical instrument 1 is brought to a state in which tone color as shown in FIG. 5 (in FIG. 5, EP represents an electric piano) is displayed on LCD display of the display section 1-5 by depression of a normal switch (NORMAL) of FIG. 4(*b*). Then, a cursor K on the display is carried to an instrument-playing mode display position as shown in FIG. 5 by depression of a cursor key (CURSOR) 3-2. Display data is changed as K→G→W by operation of a value key (VALUE) 3-3, where K represents a keyboard playing mode, G a guitar playing mode and W a wind-instrument playing mode. At this time, internal data stored in a register M of RAM 1-9 for discriminating playing modes changes its first three bits in the following way as shown in FIG. 6: 100→010→001. The above setting process of the instrument playing mode is executed at the switch-change process routine 2-6-3 of the general flow of FIG. 2. Accordingly, for example, when a player of a musical instrument uses an electronic wind instrument as an external electronic musical instrument, he will set the wind-instrument playing mode as in the above mentioned manner, when he uses an electronic stringed instrument, he will set the stringed-instrument playing mode and when he uses an electronic keyboard instrument, he will set the keyboard instrument playing mode.

AFTER-TOUCH INPUT PROCESS

Figure 7:
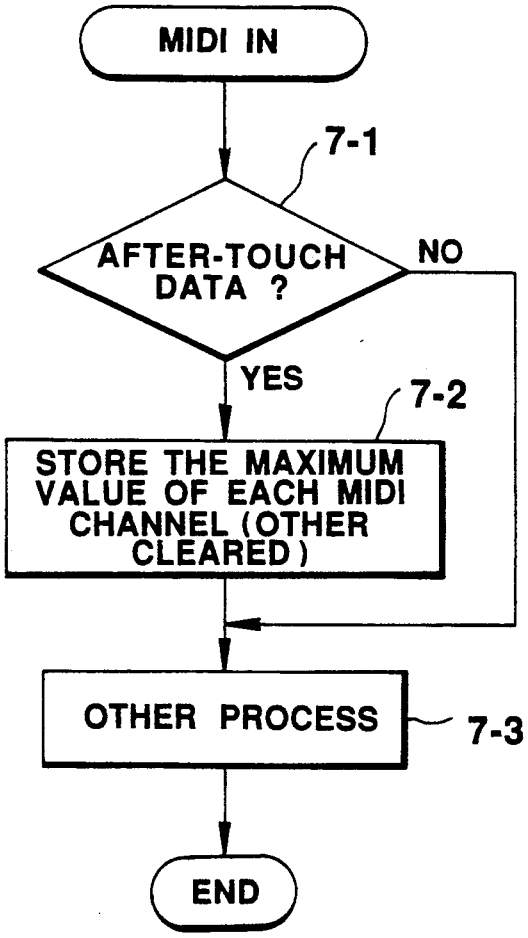
FIG. 7 is a flow-chart for selecting the maximum value of after-touch data.

As described above, every time one byte of MIDI data is input to MIDI interface 1-6, MIDI data is fetched into the micro-computer 1-2 and is stored in MIDI buffer of RAM 1-9 in accordance with the interruption routine of FIG. 2D. Process on MIDI data is executed at step 2-6-5 of the general flow (FIG. 2F). In case that after-touch data is supplied in MIDI format, and an electronic wind instrument is used as an external musical instrument, in which after-touch data is generated in response to breath flow supplied to its mouth piece, after-touch data of MIDI are frequently input to the electronic musical instrument 1 through MIDI interface 1-6 because of fine-control of breath flow. When all of these after-touch data of MIDI are to be sequentially processed, a considerable time is required to process them. Therefore, after-touch effect is provided a little late after the player's playing operation and the after-touch effect as the player expected is not realized. Hence, in the present embodiment, in order to provide after-touch effect without delay, after-touch data having the maximum value is selected as that to be processed from after-touch data which have been obtained in the present cycle at MIDI input data process routine 2-6-5. More specifically, as shown in FIG. 7, a check is made at step 7-1 as to whether after-touch data has been received. If after-touch data has been received, the after-touch data having the maximum value is searched for in each MIDI channel and is saved, and the other after-touch data are cleared.

In the present embodiment, the after-touch data having the maximum value is selected as that to be processed and depending on the ability of the electronic musical instrument in use, a time required by a process of selection of the data may be shortened to the extent that the delay of the after-touch effect causes no acoustic problem. Therefore, process of selection of the data having a value other than the maximum value may be executed. For instance, process of selection of the data having the minimum value and process of averaging operation may be executed.

STATE OF AFTER-TOUCH EFFECT

In the present embodiment, it is decided in accordance with data given in the table of FIG. 3, which element of a musical-tone after-touch data is applied to. More specifically, it is possible to modulate amp-bias and/or vibrato depth with the after-touch. Hereinafter, it is assumed that amp-bias is controlled with the after-touch. Amp-bias may be controlled with the tremolo, the modulation wheel, the definable controller and the foot volume as well as the after-touch. Amp-bias control with manipulators other than the after-touch will be described at the minimum of necessity.

PRODUCTION PROCESS OF MUSICAL-TONE CONTROL DATA

After-touch data having the maximum value selected in each cycle in the after-touch input data process is processed in the production process routine of musical-tone control data (amp-bias data). This routine is a subroutine of the control-data change process 2-2-2 in the timer interruption routine of FIG. 2B. In the production process routine of musical-tone control data of FIG. 8, amp-bias components are produced, on the basis of sense data, from manipulator data among elements affecting the amp-bias, such as MIDI after-touch data, definable controller data and foot volume data (other amp-bias components are components from tremolo obtained at routine 2-2-5). Musical instrument playing modes are taken into consideration during production of the amp-bias components and the amp-bias components are produced in different manners depending on whether or not the wind-instrument playing mode has been set. Particularly, in the embodiment, in ROM 1-8 is prepared a data-conversion table having a characteristic, according to which breath flow is non-linearly supplied to the instrument. As a result, after-touch data representing pressure of breath flow in the wind-instrument playing mode affects amp-bias in a manner which will meet the player's requirement. However, it is not preferable in capacity of memory to prepare the data-conversion table to cover the whole range of sense data. Therefore, some data are directly converted by calculation.

Figure 8:
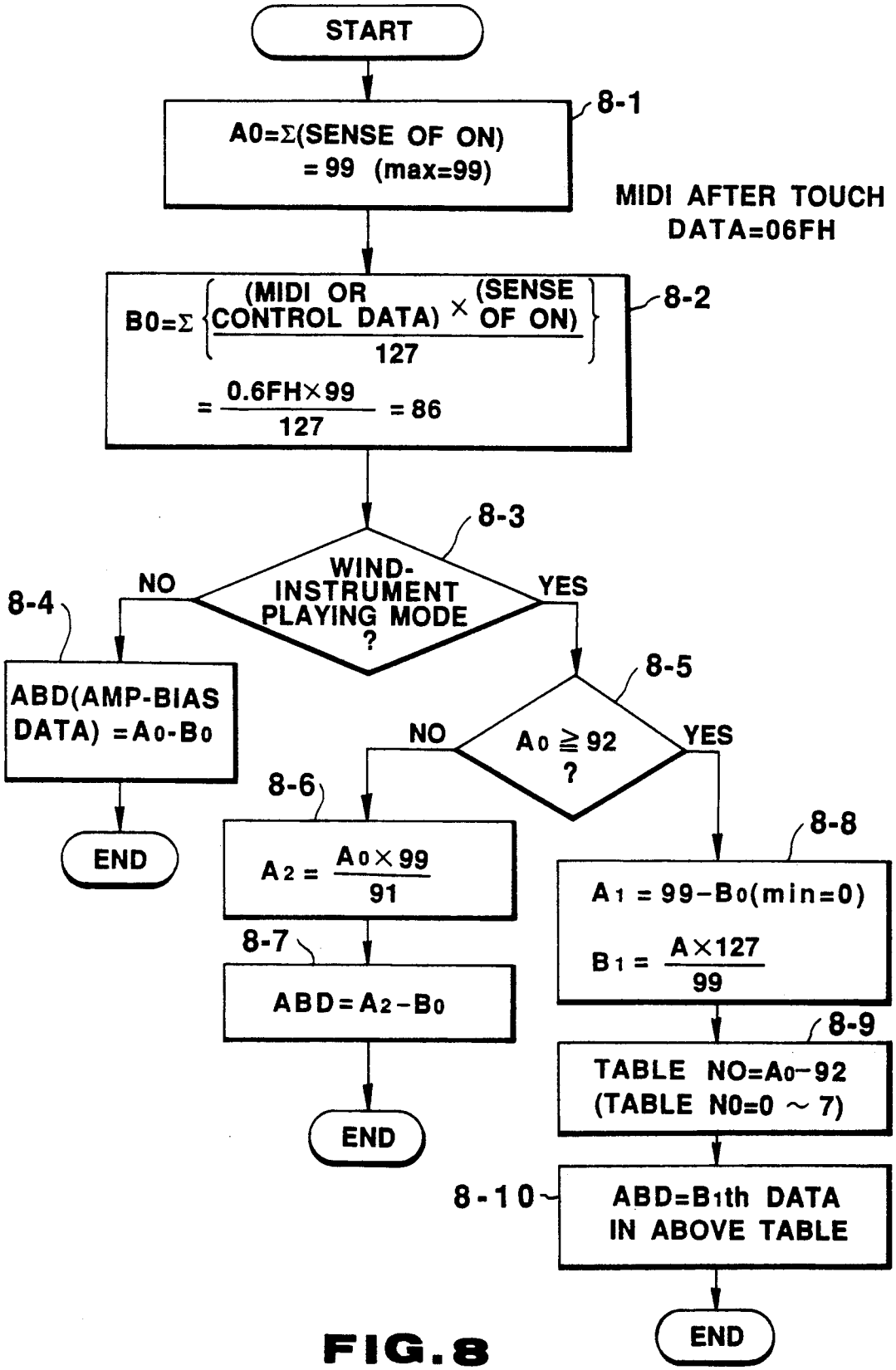
FIG. 8 is a flow-chart for producing musical-tone control data (bias data for an amplifier) from after-touch data.

In the flow of FIG. 8, the total sum of sense to which modulation of amp-bias ON is assigned is calculated at step 8-1. For instance, in set contents of FIG. 3, sense of after-touch 99 is the calculation result $A_0$. Set data of FIG. 3 may be data belonging to tone color and may be automatically changed (set) by tone-color switching. At step 8-2, the product of each manipulator data (0 to 127) to which modulation ON is assigned and sense (0 to 99) is calculated and the calculated products are divided by a value 127 for data compression to 0 to 99. The total sum of data thus obtained is calculated and set to $B_0$. For instance, when data have been set as given in the table of FIG. 3 and data 06 FH is given to MIDI after-touch data, the result will be 86. At step 8-3, a check is made as to whether the wind-instrument playing mode has been set. More specifically, bit 5 of the mode register M shown in FIG. 5 is checked, and if the bit 5 is "1", the wind-instrument playing mode has been set and if the bit 5 is "0", an instrument playing mode other than the wind-instrument playing mode has been set and the process goes to step 8-4.

At step 8-4, normalized manipulator data $B_0$ is subtracted from normalized sense $A_0$ and thereby amp-bias data ABD is obtained. As a result, in the instrument playing mode other than the wind-instrument mode, tone-volume and tone color shall change linearly in accordance with manipulator data (which may be after-touch data).

Meanwhile, in the wind-instrument playing mode, the process goes to step 8-5, where a check is mode as to whether or not the normalized sense $A_0$ is 92 and more. When the normalized sense $A_0$ is less than 92, the process goes to step 8-6. At step 8-6, sense data in the range of 0 to 91 are expanded to re-normalized sense data $A_2$ in the range of 0 to 99 and the process goes to step 8-7. At step 8-7, the normalized manipulator data $B_0$ is subtracted from the re-normalized sense data $A_2$ and thereby amp-bias data ABD is obtained.

Figure 9:
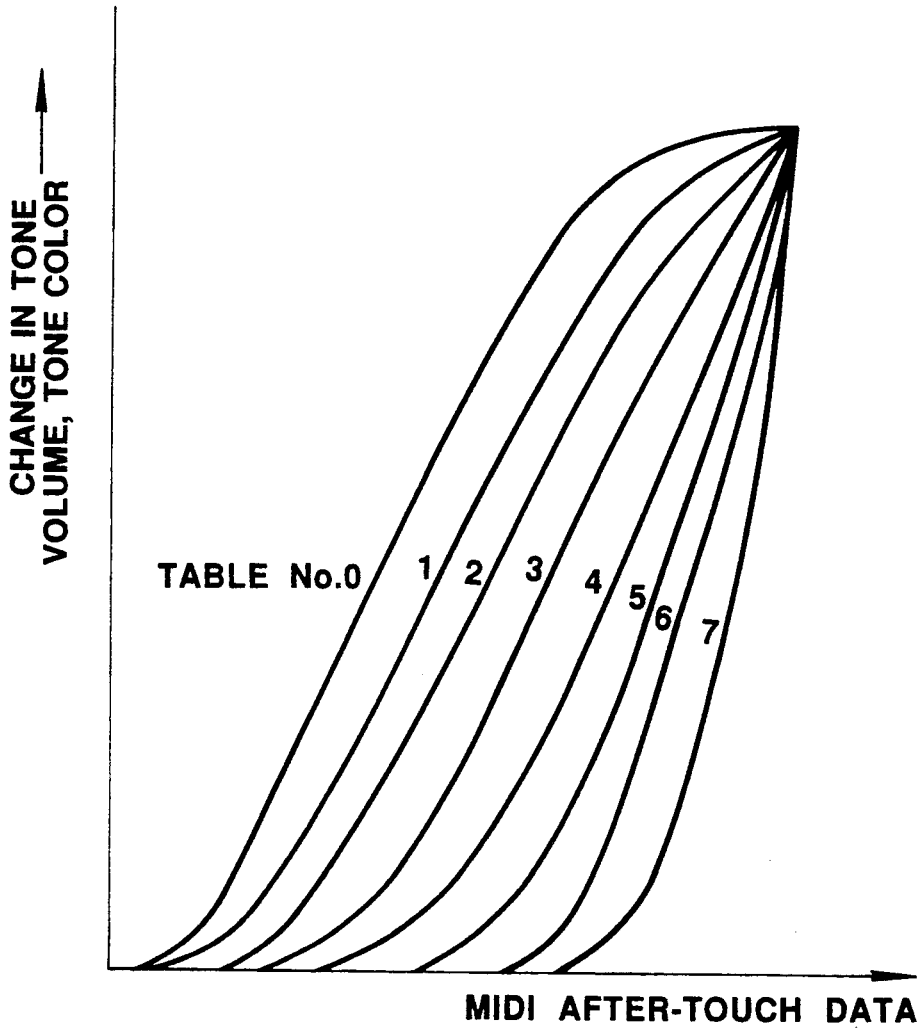
FIG. 9 is a view showing variations of sound volume and tone color of a musical tone which is generated on the basis of after-touch data, when a musical-tone control data table is selected in a wind-instrument playing mode.

When the sense data $A_0$ is 92 and more, the normalized manipulator data $B_0$ is subtracted from the sense data $A_0$ and thereby data $A_1$ (minimum 0 to 99) is obtained. The data $A_1$ is expanded into data of minimum to 127 and obtains element number $B_1$ in the conversion table (conversion table of musical-tone control data). Further, at step 8-9, a value 92 is subtracted from the sense data $A_0$ and each sense data obtains conversion-table number (0 to 7). At step 8-10, $B_1$th data in the table is read out and set to amp-bias data ABD. As a result, as shown in FIG. 9, tone volume and tone color change in accordance with values of manipulator data (MIDI after-touch data) in the range of 92≦ sense data $A_0$ in the wind-instrument playing mode.

PRODUCTION AND TRANSMISSION OF THE FINAL AMP-BIAS DATA

Figure 10:
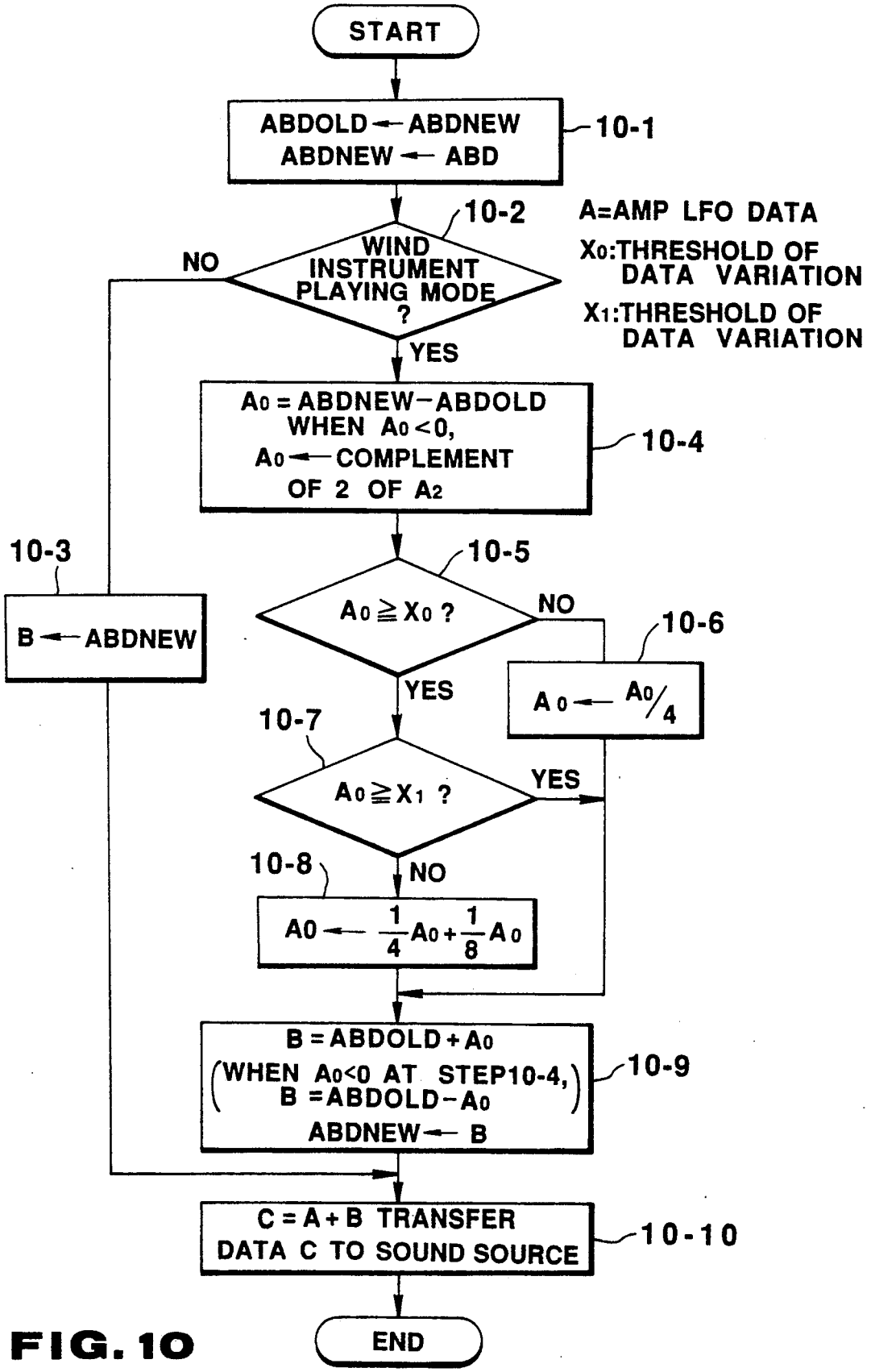
FIG. 10 is a flow-chart for smoothing bias data of an amplifier in the wind instrument playing mode, with respect to production of the final bias data of an amplifier to be sent to a sound source 1-10 of FIG. 1.

The amp-bias data generated in the process of FIG. 8 is data generated from manipulator data (which may include MIDI after-touch data) of a certain interval (cycle) and it is completely independent in the process manipulator data of other cycle. Accordingly, if the amp-bias data is transferred to the sound source 1-10 without any modification, low level variations in manipulator data of each cycle, particularly in after-touch data of each cycle representing intensity of breath flow supplied to the wind-instrument will affect tone-volume and tone color of musical tones, generating discordant sounds. Hence, it is preferable to process the amp-bias data such that generation of the discordant sounds is prevented and characteristics of sounds varies smoothly. Then, amp-bias components of LFO tremolo are added to the amp-bias, which is supplied to the sound source 1-10 as the final amp-bias. In the embodiment, the above process of the amp-bias is executed at one volume and tone color changing process 2-2-6 in the timer-interruption routine of FIG. 2B. The details thereof are shown in FIG. 10.

At step 10-1, the preceding amp-bias data stored in ABDNEW is transferred to ABDOLD to renew data and the amp-bias data ABD generated from the present manipulator data in the process of FIG. 8 is set to ABDNEW. At the following step 10-2, a check is mode as to whether the wind-instrument playing mode has been set. If a mode other than the wind-instrument playing mode has been set, the amp-bias data (data in ABDNEW) generated from the present manipulator data is transferred to B, since there is no problem of generation of discordant sounds. Amp-bias components generated with the LFO tremolo at routine 2-2-5 are added to the value B and thereby a final amp-bias data C is obtained and transferred to the sound source 1-10, at steps 10-3, 10-10.

Meanwhile, in the wind-instrument playing mode, after-touch data representing the intensity of breath flow sometimes shows a state in which low level random variations are continuously caused in each cycle of after touch data, though the player tries to supply breath flow at a constant level. In this case, amp-bias data is directly influenced by these low level variations. Therefore, if the similar processes of steps 10-3, 10-7 to those in the mode other than the wind-instrument playing mode are executed, discordant variation shall be caused in musical tones. In the present embodiment, as shown at steps 10-4 to 10-9, variations in each cycle of after-touch data are evaluated. If the variations are of high level, the after-touch data are processed without any modification as it is judged that the player's intention seems to be represented on the after-touch data. If the variations are of small level, two stages of processes are executed to smooth the amp-bias data ABD. The difference between after-touch data of respective cycles is detected by comparing the preceding amp-bias data ABDOLD with the present amp-bias data ABDNEW. At step 10-4, the difference $A_0$ between these amp-bias data is obtained. At the following step 10-5, a check is mode as to whether the difference $A_0$ is less than the threshold value $X_0$. If the difference $A_0$ is less than the threshold value $X_0$, a process is executed at step 10-6 to make the difference $A_0$ small (to its one fourth level), because it is judged that the amp-bias data are varying in a low-level range. If the difference $A_0$ is $X_0$ and more, and less than the second threshold $X_1$ ($>X_0$), the difference $A_0$ is changed to a value of $\frac{1}{4}A_0+\frac{1}{8}A_0$ at steps 10-7, 10-8. An arbitrary appropriate data-compression process may be used as the operation process of steps 10-6, 10-9. Variations of after-touch data and/or amp-bias data may be evaluated in a process other than that shown at step 10-4. The difference $A_0$ selectively data-compressed in accordance with the level of the difference $A_0$ is added or subtracted from the preceding amp-bias data ABDOLD. The result B of the above addition or subtraction is saved in ABDNEW as the present amp-bias data of the manipulator. The data B is obtained by smoothing after-touch data of each cycle. The smoothed amp-bias data B of the manipulator is added to amp-bias data A of the LFO tremolo, and then transferred as the final amp-bias data C to the sound-source 1-10 at step 10-10 in the same manner as that in other instrument playing mode. As a result, when after-touch data representing the intensity of breath flow is input to the present electronic musical instrument 1 in the wind-instrument playing mode, there is caused no characteristic variation of generation of fractional and unnatural musical tones, which is shown by a conventional electronic musical instrument.

The embodiment of the present invention has been described above, however it will be appreciated that there are a number of variations and modifications without a departure from the sprit and the scope of the invention. For instance, in the above embodiment, only tone volume, tone color and tone pitch have been described as components of a musical tone, which are affected by after-touch, but it is possible to cause the after-touch to affect elements of effecters. Further, iPD sound source is described as an example of the sound source 1-10, but other arbitrary appropriate digital-sound-source may be used. After-touch data has been described as data representing the intensity of breath flow, but the after-touch data may be other air-flow data such as data of intensity of biting lips. In the wind-instrument playing mode, a conversion table is used to realize a non-linearity when musical-tone control data is generated on the basis of after-touch, an approximate characteristic of non-linearity may be calculated, provided that a processing time causes no particular problem. The control apparatus may be designated such that the user programs the conversion table and/or characteristic functions.

What is claimed is:

1. A control apparatus for an electronic musical instrument, comprising:

after-touch data receiving means for periodically receiving after-touch data in response to a musical playing operation;

mode selecting means for selecting a desired instrument playing mode from a plurality of instrument playing modes including at least a wind-instrument playing mode and a keyboard-instrument playing mode, the playing modes having methods of musical playing different from each other;

mode storing means coupled to said mode selecting means for storing data representing the instrument playing mode selected by said mode selecting means;

control data generating means for generating control data from the after-touch data received by said after-touch data smoothing means including means for calculating a difference between a preceding control data and a present control data from said control data generating means and means for generating a final control data by executing a smoothing operation against the difference and at least one of the preceding control data and the present data; and control data outputting means including means for outputting the final control data from said smoothing means to control a characteristic of a musical tone when the data representing the wind-instrument playing mode is stored in said mode storing means and the variation of the control data is small, and means for outputting the control data from said control data generating means to control the characteristic of the musical tone when the data representing the keyboard-instrument playing mode is stored in said mode storing means, or when the data representing the wind-instrument playing mode is stored in said mode storing means and the variation of the control data is large.

2. A control apparatus for an electronic musical instrument according to claim 1, wherein said after-touch data receiving means receives the after-touch data from a performance input apparatus of a musical instrument and MIDI interface.

3. A control apparatus for an electronic musical instrument according to claim 1, wherein display means is further provided for displaying a data representing instrument playing mode stored in said mode storing means.

4. A control apparatus for an electronic musical instrument according to claim 1, wherein said smoothing means compresses the difference in correspondence to a value of the difference and adds up the compressed difference and the preceding control data to generate the final control data.

5. A control apparatus for an electronic wind instrument comprising:

sensor output receiving means for receiving breath-sensor output data from a breath-sensor periodically;

control data generating means for generating a control data from the breath-sensor output data received by said sensor output receiving means;

smoothing means including means for calculating a difference between a preceding control data and a present control data from said control data generating means and means for generating a final control data by executing a smoothing operation against the difference and at least one of the preceding control data and the present control data; and control data outputting means including means for outputting the control data from said control data generating means when an amplitude of a variation of the breath-sensor output data is large, and means for outputting the final data from said smoothing means when the amplitude of the variation of the breath-sensor output data is small.

* * * * *

UNITED STATES PATENT AND TRADEMARK OFFICE

CERTIFICATE OF CORRECTION

PATENT NO. : 5,119,712

DATED : June 9, 1992

INVENTOR(S) : Hitoshi KATO

It is certified that error appears in the above-identified patent and that said Letters Patent is hereby corrected as shown below:

Column 15, line 3 (claim 1), after "after-touch data", insert --receiving means;--.

Signed and Sealed this

Second Day of March, 1993

*Attest:*

STEPHEN G. KUNIN

*Attesting Officer*

*Acting Commissioner of Patents and Trademarks*